US007557782B2

(12) United States Patent
Anthony et al.

(10) Patent No.: US 7,557,782 B2
(45) Date of Patent: Jul. 7, 2009

(54) DISPLAY DEVICE INCLUDING VARIABLE OPTICAL ELEMENT AND PROGRAMMABLE RESISTANCE ELEMENT

(75) Inventors: Thomas C. Anthony, Sunnyvale, CA (US); Lung T. Tran, Saratoga, CA (US); Gary Alfred Gibson, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 703 days.

(21) Appl. No.: 10/969,085

(22) Filed: Oct. 20, 2004

(65) Prior Publication Data

US 2006/0082526 A1 Apr. 20, 2006

(51) Int. Cl.
*G09G 3/32* (2006.01)

(52) U.S. Cl. ..... 345/82; 345/83

(58) Field of Classification Search ..... 345/82, 345/55, 87, 75.2, 45, 46, 76, 204, 212, 89, 345/102; 706/33; 341/121; 250/559.45; 324/600; 349/2; 359/296; 430/1; 700/293; 365/200

See application file for complete search history.

(56) References Cited

U.S. PATENT DOCUMENTS 3,873,181 A * 3/1975 Chivian et al. ..... 430/1
4,110,014 A * 8/1978 Yevick ..... 349/2
5,422,982 A * 6/1995 Pernisz ..... 706/33
5,550,384 A * 8/1996 Nickell ..... 250/559.45
6,107,985 A * 8/2000 Walukas et al. ..... 345/102
6,307,490 B1 * 10/2001 Litfin et al. ..... 341/121
6,724,519 B1 * 4/2004 Comiskey et al. ..... 359/296
6,861,810 B2 * 3/2005 Rutherford ..... 315/169.3
7,110,864 B2 * 9/2006 Restrepo et al. ..... 700/293
2002/0140641 A1 * 10/2002 Mikami et al. ..... 345/75.2
2003/0052840 A1 * 3/2003 Shannon ..... 345/55
2003/0053350 A1 * 3/2003 Krieger et al. ..... 365/200
2003/0122789 A1 7/2003 Sharma ..... 345/173
2003/0122805 A1 * 7/2003 So ..... 345/204
2003/0137521 A1 * 7/2003 Zehner et al. ..... 345/589
2003/0179633 A1 * 9/2003 Krieger et al. ..... 365/200
2004/0130274 A1 * 7/2004 DuLaney et al. ..... 315/291
2004/0246768 A1 * 12/2004 Krieger et al. ..... 365/154
2006/0044878 A1 * 3/2006 Perner ..... 365/189.01
2006/0087324 A1 * 4/2006 Berggren et al. ..... 324/600

FOREIGN PATENT DOCUMENTS

JP 2003233333 8/2003
JP 2004191574 7/2004
WO WO-03107316 12/2003

* cited by examiner

*Primary Examiner*—Prabodh M. Dharia

(57) ABSTRACT

A display element includes a variable optical element that changes appearance in response to changes in current, and a programmable resistance in series with the variable optical element. The resistance of the programmable resistance decreases in response to a first current in a first direction. The resistance of the programmable resistance increases in response to a second current in a second direction.

28 Claims, 8 Drawing Sheets

DISPLAY DEVICE INCLUDING VARIABLE OPTICAL ELEMENT AND PROGRAMMABLE RESISTANCE ELEMENT

BACKGROUND OF THE INVENTION

Many displays include an array of pixels organized in rows and columns. Selecting a row and selecting a column enables addressing of a pixel in the array. There are two categories of addressing schemes. One is referred to as a passive matrix addressing scheme in which the row and column drivers are multiplexed to turn pixels on and off in the array. Another addressing is referred to as an active matrix addressing scheme in which one or more thin film transistors ("TFT") is associated with each of the pixels in the display to turn the pixel on and off. Generally, the displays that use a passive addressing scheme are referred to as passive displays and the displays that use an active addressing scheme are referred to as active displays.

Currently, both passive and active displays have data reside in an external memory. In other words, the memory is remote from the pixel. The data is sent to the pixels via rows and columns in the form of voltage pulses. As a result, the pixels are refreshed for both the passive displays and the active displays. The refresh rates are high and expected to increase as displays become more complex. For example, high definition television ("HDTV") uses a display having an array of pixels of 1080×1920. The refresh rate of the entire image is generally between 60-90 frames per second. As the number of rows increase, the amount of time that may be spent addressing each row becomes shorter because memory is remote from the pixel. Static or quasi-static display applications even have high refresh rates.

Although in principal passive displays appear to be easier to fabricate, complex schemes are implemented in order to address each pixel. In a large display, such as an HDTV display, as the number of rows and number of columns increase, the time available to address each pixel becomes shorter. If a display is a liquid crystal display, the response time for such programming is slow enough so that, eventually, the pixel does not respond well and contrast between on and off pixels is poor. If a display is an OLED display, the brightness of each pixel is increased in proportion to the number of rows in the display, since rows are activated one at a time. Consequently, large current densities are used in passive OLED displays, leading to high power consumption.

Active displays include one or more TFTs to address each pixel and generally are much more difficult to fabricate. The difficulty in fabrication translates to expense passed on to consumers. In some instances, the cost may be prohibitive for many consumers. The active displays also use a glass substrate. Complex processes are also generally used to fabricate an active matrix display.

DETAILED DESCRIPTION

In the following description, the drawings illustrate specific embodiments of the invention sufficiently to enable those skilled in the art to practice it. Other embodiments may incorporate structural, logical, electrical, process, and other changes. Examples merely typify possible variations. Individual components and functions are optional, and the sequence of operations may vary. Portions and features of some embodiments may be included in or substituted for those of others. The scope of the invention encompasses the full ambit of the claims and all available equivalents. The following description is, therefore, not to be taken in a limited sense, and the scope of the embodiments of the present invention is defined by the appended claims.

Figure 1:
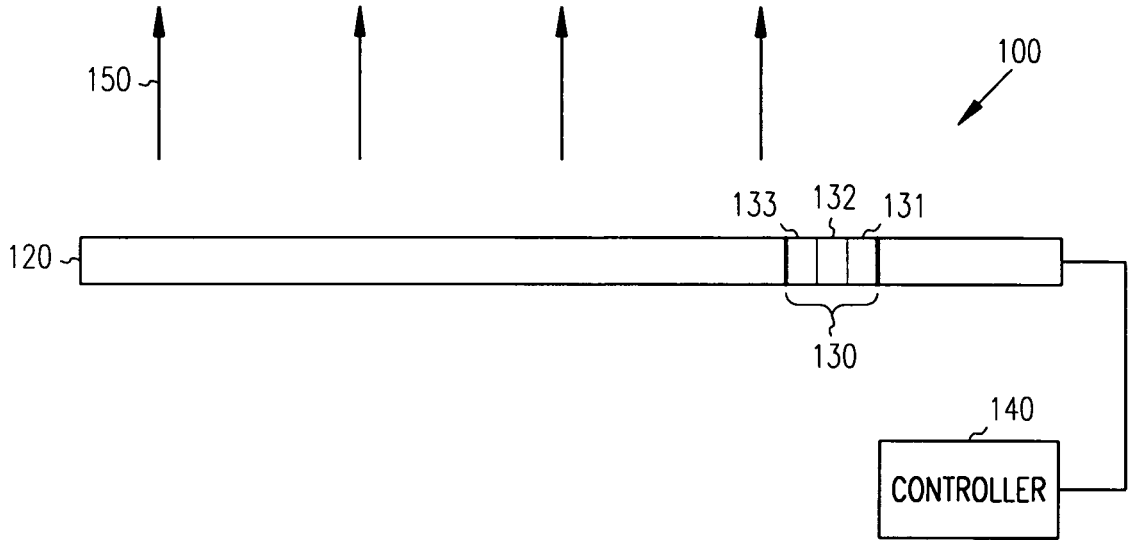
FIG. 1 is a schematic diagram of a display, according to an example embodiment.

FIG. 1 is a schematic diagram of a display device 100, according to an example embodiment. The display device 100 includes a spatial light modulator 120 that includes at least one cell or a plurality of cells 130. In some embodiments of the invention, each of the cells 130 corresponds to a pixel on the display device 100. Each of the cells 130 may include a set of subpixels 131, 132, 133 that include individual display elements, such as a display element 300 (shown in FIG. 3), 400 (shown in FIG. 4), 500 (shown in FIG. 5), 600 (shown in FIG. 6), or 700 (shown in FIG. 7). The number of subpixels in a cell may be related to the number of colors used to form the display device 100. For example, three subpixels 131, 132, and 133 are selected in a RGB display device. Attached to the spatial light modulator 120 is a controller 140. The controller 140 receives image information for the spatial light modulator 120 and controls the spatial light modulator to produce an image or series of images. The controller 140 controls at least one cell 130 or at least one subpixel of the subset of subpixels 131, 132, 133 of the spatial light modulator 120. In another embodiment, the controller 140 controls a plurality or multiplicity of cells 130 (one shown in FIG. 1) placed in an array and associated with the spatial light modulator 120 in order to produce an image. In the embodiments where there is a plurality of cells or pixels 130, the cells or pixels 130 are individually connected to the controller 140. More specifically, each of the subpixels 131, 132, 133 is connected to the controller 140. Each subpixel 131, 132, 133 may be individually addressed or controlled in order to produce a chosen image. The subpixels 131, 132, 133 change state to produce selected light, depicted by arrow 150, at each cell or pixel 130. The display device 100 shown in FIG. 1 is an emissive display device. In another example embodiment, the display device 100 may be a transmissive display device or any other display device. A transmissive display device may include a reflective type of transmissive display.

Figure 2:
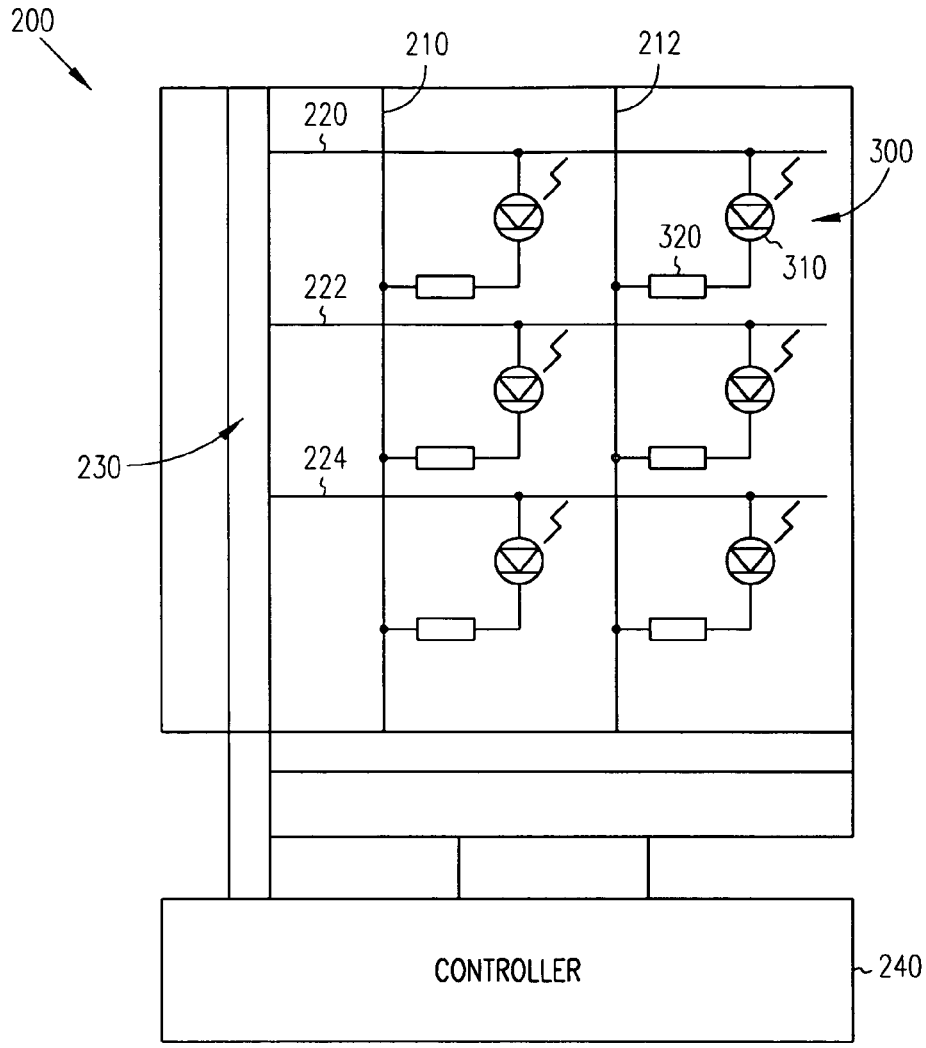
FIG. 2 is a schematic diagram of an array of display elements that form part of a display device, according to an example embodiment.

FIG. 2 is a schematic diagram of an array 200 of display elements 300 that form part of a display device 100, according to an example embodiment. As shown in FIG. 2, the array includes three rows and two columns of display elements 300. Each of the display elements in FIG. 2 is substantially the same. As a result, only one will be discussed in detail and labeled. Each display element 300 includes a variable optical element 310 that changes appearance in response to changes in current. The variable optical element 310 is connected in series with a programmable resistance 320. As shown in FIG. 2, the variable optical element 310 is a light emitting diode ("LED"). In some embodiments, the variable optical element 310 is an organic light emitting diode ("OLED"). The array includes two columns of conductors 210, 212 and three rows of conductors 220, 222, 224. The rows and columns of conductors are connected to one another through a display element. For example, as shown in FIG. 2, the display element 300 connects the column conductor 212 and the row conductor 220.

A decoder and logic 230 is positioned on one side of the array 200. A controller 240 is also electrically coupled to the array 200. The controller controls the application of voltage to the various columns of conductors 210, 212 and rows of conductors 220, 222, 224 in response to image data received by the decoder and logic 230. The controller 240 programs the programmable resistances 320 to enable or disable individual optical elements 310 in the array 200 to form images. Of course, the array 200 shown here is only illustrative in that it shows six display elements 300. An array 200 may have any number of display elements, including many more display elements and form a much larger array.

Figure 3:
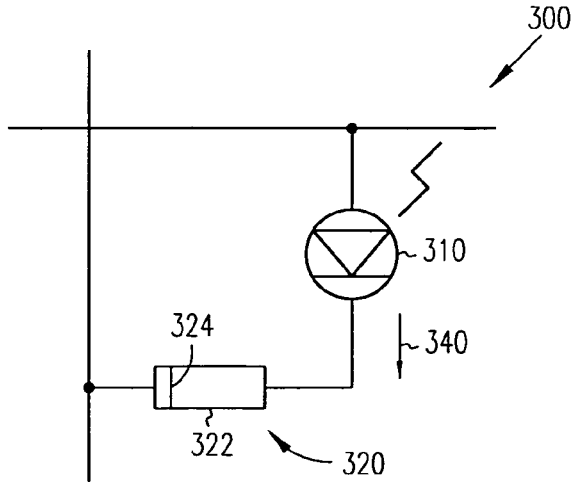
FIG. 3 is a schematic diagram of a display element, according to an example embodiment.

FIG. 3 is a schematic diagram that further details the display element 300 shown in FIG. 2. The programmable resistance 320 is also further detailed in FIG. 3. For the sake of simplicity and discussion, the programmable resistance is shown to include an electrolyte portion 322 and at least one material 324 that is a source of ions and electrons. The resistance of the programmable resistance 320 increases in response to a current flow in a first direction. The resistance of the programmable resistance 320 decreases in response to a current flow in a second direction or opposite direction. Thus the programmable resistance 320 may also be considered as a switch having an "on" or conductive state and an "off" state or resistive state. One example of a programmable resistance 320 is available from AXON Technologies Corporation having an address of 2625 S. Plaza Drive in Tempe, Ariz. as a Programmable Metallization Cell memory ("PMCm"). The electrolyte is a solid electrolyte. The source of ions and electrons are silver atoms. Silver may be dissolved in chalcogenide glasses up to many tens of atomic percent to form ternary compounds that act as high ion mobility solid electrolytes. Forming electrodes in contact with a layer of such a solid electrolyte, an anode which has oxidizable silver and an inert cathode, creates a device that has an intrinsically high resistance but which may be quickly switched to a low resistance state. At an applied bias of a few hundred mV in stacked thin-film structures, the silver ions are reduced at the cathode and the silver in the anode oxidized. The result of this electrochemical reaction is the rapid formation of a stable conducting electrodeposit extending from cathode to anode. The state may also be quickly switched from a low resistance state to a higher resistance state by reversing the electrode polarities. Reversing the bias drives the electrode-deposited silver back toward the anode thereby reducing the conductivity of the programmable resistance 320.

It should be noted that in some embodiments of the invention the programmable resistance 320 does not have a definite electrolyte portion 322 or a definite material 324 that is the source of ions and electrons. In some embodiments, the material changes structure so as to form more conductive or more resistive states based on direction of current flow or bias.

Other embodiments of the programmable resistance may include different materials. The solid electrolyte may include germanium selenide, germanium sulphide, copper sulphide, silver sulphide, copper selenide, or any other solid electrolyte. The cathode may include any type of metal that supply electrons. The anode may include silver, copper or the like.

In operation, the array 200 is programmed during a programming cycle and viewed during a viewing cycle. During the programming cycle, current may be driven in the direction of the arrow 340 (a first direction) to program the programmable resistor 320 to a resistive state. Current flowing in the direction of arrow 340 causes the optical element or light emitting diode 310 to emit light. When current is driven in a direction opposite the arrow 340 (a second direction), the programmable resistor is programmed to a conductive state. In order to drive current in a direction opposite the arrow 340, the light emitting diode 310 is reversed biased. In some instances, the light emitting diode is not to be reverse biased.

The programmable resistance 320 of each of the display elements 300 may be programmed to a conductive state or to a resistive state, as described above. In one example embodiment, programming may be done one display element at a time. In another example embodiment, a multiplicity of display elements on a row may be programmed simultaneously by independent control of column voltages. In one example embodiment, the bias of a row or group of rows is set. Then groups of columns may be programmed. The groupings of columns may be of any size. Once each programmable resistance 320 of each of the display elements 300 is programmed during the programming cycle, the rows are connected to a supply voltage and the columns are connected to ground during a viewing cycle. This results in powering substantially the entire array 200 of display elements 300 without having to refresh the display elements 300. The optical state of each display element 300 is determined by the resistance of programmable resistance 320. In one example embodiment, the display element 300 may be programmed to one of a plurality of resistance levels. At higher levels of resistance, less current flows through the display element 300. Thus, the programmable resistor 320 may be programmed to control a light output from a variable optical element 310, such as an OLED to provide a gray scale capability for the various display elements.

Figure 4:
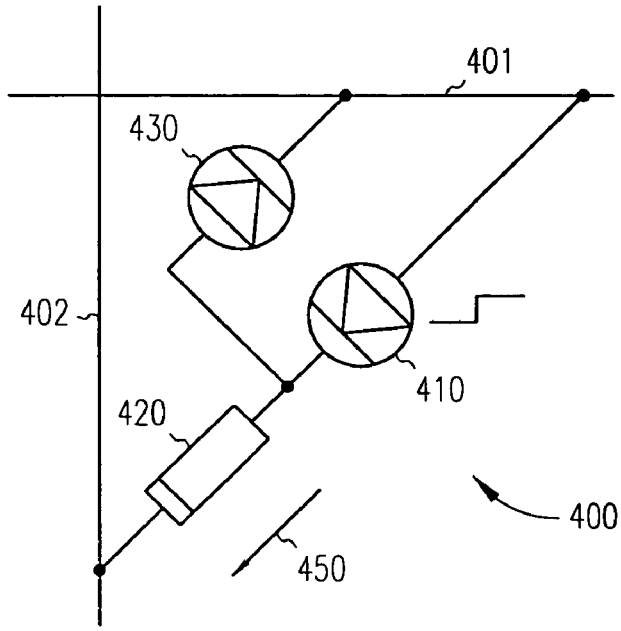
FIG. 4 is a schematic diagram of a display element, according to an example embodiment.

FIG. 4 is a schematic diagram of a display element 400, according to another example embodiment. The display element 400 includes a variable optical element 410 that changes appearance in response to changes in current. The variable optical element 410 is connected in series with a programmable resistance 420. Connected in parallel with the optical element is a diode 430. As shown in FIG. 4, the variable optical element 410 is a light emitting diode ("LED"). In some embodiments, the variable optical element 410 is an organic light emitting diode ("OLED"). The diode 430 is connected to provide an additional current path so that the programming current does not have to pass through a reverse biased light emitting diode or optical element 410 during the programming cycle of an array containing the display element 400. As mentioned above, when driving current is in a first direction, such as when the row conductor 401 has a higher potential than the column conductor 402 (depicted as direction arrow 450), the light emitting diode is forward biased and allows current to pass through the programmable resistance 420. Substantial current does not pass through the diode 430 when diode 430 is reverse biased. Application of sufficient voltage across the programmable resistor 420 in this bias configuration programs the resistor to the resistive state. When the column conductor 402 is at a higher potential than the row conductor 401, current flows through the programmable resistor in a direction opposite the arrow 450 (or in a second direction). Application of sufficient voltage across the programmable resistor 420 in this second bias configuration programs the resistor to the conductive state. Under this second bias configuration, current flows through the diode 430 to the row conductor 401 and does not flow through the optical element or light emitting diode 410, since the optical element or light emitting diode 410 is reverse biased.

Figure 5:
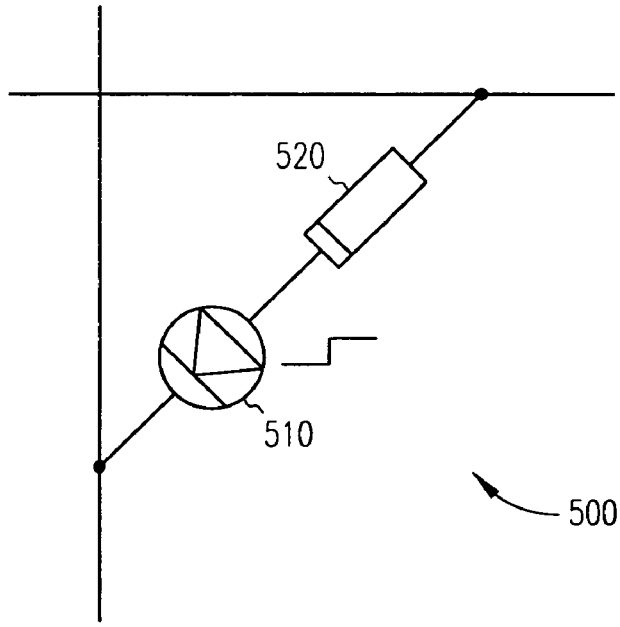
FIG. 5 is a schematic diagram of a display element, according to an example embodiment.

FIG. 5 is a schematic diagram of a display element 500, according to another example embodiment. This particular embodiment varies slightly from the embodiment shown in FIG. 3 in that the optical element and the programmable resistance are switched.

Figure 6:
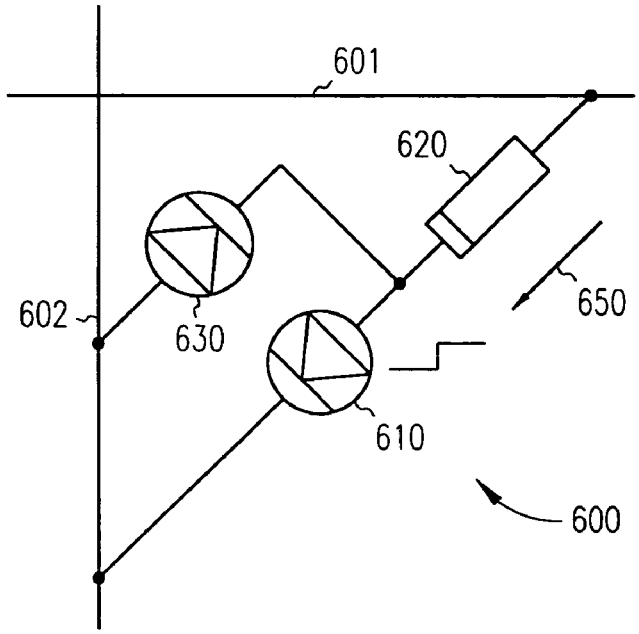
FIG. 6 is a schematic diagram of a display element, according to an example embodiment.

FIG. 6 is a schematic diagram of a display element 600, according to another example embodiment. This particular embodiment varies slightly from the embodiment shown in FIG. 4 in that the optical element 610 and the programmable resistance 620 are switched. A diode 630 is added to provide a current path that prevents the reverse biasing of light emitting diode 610. In other words, when driving current in a first direction, such as when a row conductor 601 has a higher potential than the column conductor 602 (depicted as direction arrow 650) the light emitting diode allows current to pass and current flows through the programmable resistance 620. Substantial current does not pass through reverse biased diode 630. When the column conductor 602 is at a higher potential than the row conductor 601, current flows through the programmable resistor in a direction opposite the arrow 650 (or in a second direction). In an embodiment, current flows through the diode 630 to the row conductor 601 and does not flow through the reverse biased optical element or light emitting diode 610.

Figure 7:
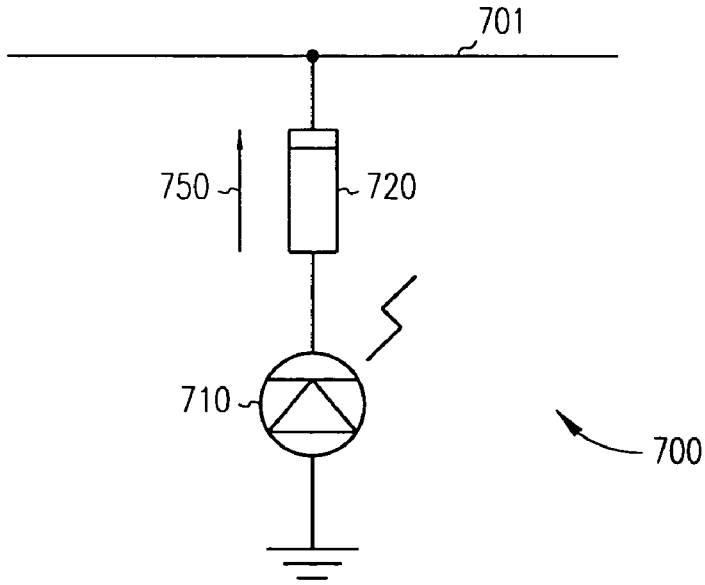
FIG. 7 is a schematic diagram of a display element, according to an example embodiment.

FIG. 7 is a schematic diagram of a display element 700, according to another example embodiment. As in the other embodiments, the display element 700 includes a variable optical element 710 and a programmable resistance 720. The programmable resistance 720 and the variable optical element 710 are connected in series. One end of the display element 700 is connected to ground and the other element is connected to a row conductor 701. In this embodiment, row conductor 701 is driven to minus voltage to produce current flow in a direction 750 either during a programming cycle or a viewing cycle.

Figure 8:
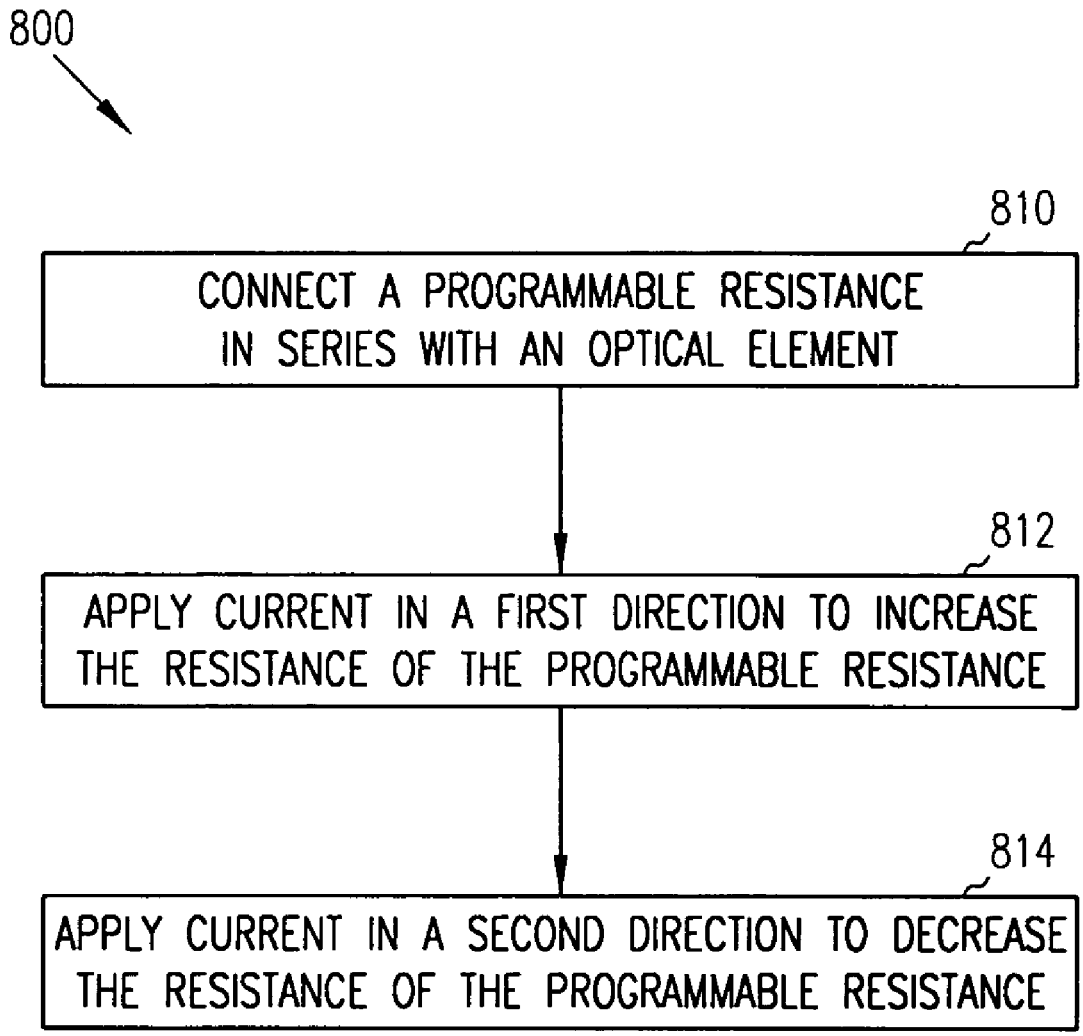
FIG. 8 is a flow diagram of a method, according to an example embodiment.

FIG. 8 is a flow diagram of a method 800, according to an example embodiment. The method 800 includes connecting a programmable resistance in series with an optical element 810, applying current in a first direction to increase the resistance of the programmable resistance 812, and applying current in a second direction to decrease the resistance of the programmable resistance 814. It should be noted that when programming programmable resistances, the current direction is caused by applying voltages or biasing various conductors associated with the programmable resistance. In other words, programming may be done using voltages or biases that cause current flows. It should also be noted that many times the differences in voltage across the programmable resistor may have to overcome certain threshold values to program the programmable resistance. In some embodiments further applying a lower level current in the first direction lights the optical element. In some embodiments, applying current in a second direction to decrease the resistance of the programmable resistance includes placing a diode in parallel with the optical element. The diode has a path of least resistance in the second direction of current flow. Applying current in a first direction to the programmable resistance includes diffusing at least some of ions in the electrolyte to a position outside the electrolyte. Applying current in a second direction to the programmable resistance includes diffusing at least some of a source of ions into the electrolyte.

A display including a variable optical element that changes appearance in response to changes in current, and a programmable resistance in series with the variable optical element. The resistance of the programmable resistance increases in response to a current in a first direction. The resistance of the programmable resistance decreases in response to a current in a second direction. The current in the second direction is opposite the current in the first direction. In some embodiments, the variable optical element includes a light emitting diode. In other embodiments, the variable optical element includes an organic light emitting diode. The programmable resistor includes an electrolyte, and a source of ions that diffuses out of the electrolyte in response to current in the first direction and a source of ions that diffuses into the electrolyte in response to current in the second direction. It should be noted that in some embodiments of the invention the programmable resistance 320 does not leave a definite electrolyte portion 322 or a definite material 324 that is the source of ions and electrons. In some embodiments, the material changes structure so as to form more conductive or more resistive states based on direction of current flow or bias. In some embodiments, the display also includes a diode connected in parallel to the optical element such that the diode passes current in one of the first and second direction without having to pass current through the optical element. The light emitting diode has a first polarity in a first direction and the diode has a second polarity in a second direction. The diode is connected in parallel to the light emitting diode such that the diode passes programming current without having to pass programming current through the optical element. The diode is connected in parallel to the light emitting diode such that the polarity of the diode opposes the polarity of the light emitting diode.

A display includes a plurality of display variable optical elements arranged in an array. It should be noted, pixels may not be identical as some may emit different colors of light or may be programmed using different biases to cause current flow. The resistance of the programmable resistance increases in response to a current in a first direction, and decreases in response to a current in a second direction. The display also includes a plurality of rows of conductors and a plurality of columns of conductors. At least a portion of the display elements are connected between one of the plurality of rows of conductors and one of the plurality of columns of conductors. The display also includes a source of current for selectively increasing or decreasing the resistance of the programmable resistance. The optical element includes a light emitting diode, in one embodiment, and includes an organic light emitting diode in another embodiment. The programmable resistor includes an electrolyte, and a source of ions that diffuses out of the electrolyte in response to current in the first direction and that diffuses into the electrolyte in response to current in the second direction. In some embodiments, a diode is connected in parallel to the optical element such that the diode passes current in one of the first and second direction without having to pass current through the optical element. The light emitting diode has a polarity in a first direction and the diode has a polarity in a second direction. The diode is connected in parallel to the light emitting diode such that the diode passes programming current without having to pass programming current through the optical element. The diode is connected in parallel to the light emitting diode such that the polarity of the diode opposes the polarity of the light emitting diode.

In one example embodiment, an array 200 (see FIG. 2) of display elements, such as display element 300 or display element 400, may be formed using printed electronics. Printed electronics is an additive process that uses low cost techniques, such as ink jet printing or some other printing mechanism, to put down materials on a substrate that are used to form the display elements. Initially, a first set of column conductors is produced by using an ink jet to lay down a colloidal suspension of silver particles on a substrate. The silver particles coalesce upon heating to form silver conductors, which also serve as the anodes 324 of the programmable resistors 320. Next, a similar inkjet printing process is used to place germanium selenide in an array of dots on top of the silver conductors. A thin silver layer is then deposited on top of the germanium selenide dots and photo-diffused into the germanium selenide to create a layer of germanium selenide with silver therein. This forms the solid electrolyte portion 322 of the programmable resistive element 320. A metallic cathode is then placed over the solid electrolyte portion 322. An OLED is then formed in the next several layers over the cathode of the completed programmable resistive element 320. An OLED is an organic diode formed of several layers of organic polymer. The layers of organic polymer are placed over the cathode using a printing process, such as ink jet printing. Next, a set of row conductors is placed on the substrate. The rows of conductors intersect a top surface of the OLED formed on the programmable resistive element on the columns of conductors. It is contemplated that the substrate could be flexible. In addition, the substrate could be opaque or clear in color. If an opaque substrate is used, a clear protective coating could be placed over the array of display elements formed. The result is a programmable resistor/OLED combination that is a two terminal device. The programmable resistor/OLED consumes less area than a transistor/OLED combination. In addition, low cost deposition methods, namely printing processes, may be used to fabricate the display device or an array of display devices.

Figure 9:
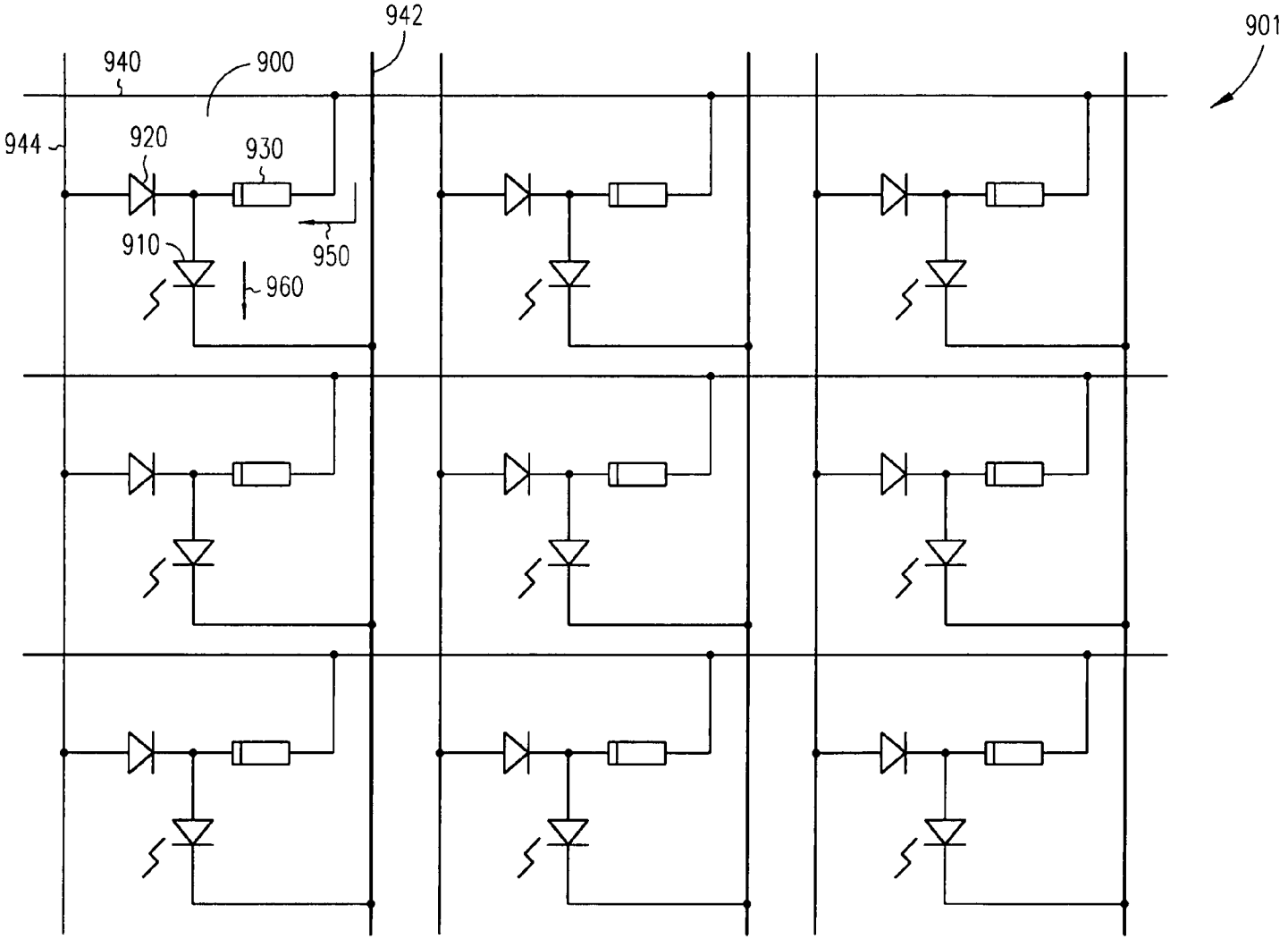
FIG. 9 is a schematic diagram of an array having a plurality of display elements, according to an example embodiment.

FIG. 9 is a schematic diagram of an array 901 having a plurality of display elements, including a display element 900 that includes a variable optical element 910, a diode 920 and a programmable resistance 930, according to an example embodiment. The array 901 may be a portion of a display. The array 901 includes a number of display elements. Since the display elements are substantially the same, one display element 900 is described below. The display element 900 also includes a row conductor 940, a primary column conductor 942, and an auxiliary column conductor 944, according to an example embodiment. The programmable resistance 930 is coupled to the row conductor 940. The programmable resistance 930 is also coupled to the variable optical element 910 and the diode 920. The diode 920 is coupled to the auxiliary column conductor 944. The variable optical element 910 is coupled to the primary column conductor 942. As shown in FIG. 9, the variable optical element 910 is a light emitting diode ("LED"). In some embodiments, the variable optical element 910 is an organic light emitting diode ("OLED").

In operation, the array 901 is programmed during a programming cycle and viewed during a viewing cycle. During the programming cycle, current may be driven in the direction of an arrow 950 (a first direction) to program the programmable resistor 930 to a resistive state. When programming the programmable resistance 930 to a resistive state, the row conductor 940 is at a high voltage and the primary column conductor 942 is at a low voltage state. Aa small amount of current flows through the diode 920 since current flow in the direction of the arrow 950 through the diode 920 is in a reverse bias direction of the diode 920. The majority of the current also flows in the direction of arrow 960 through the variable optical element 910. Current flowing in the direction of an arrow 960 causes the variable optical element or light emitting diode 910 to emit light.

When current is driven in a direction opposite the arrow 950 (a second direction), the programmable resistance 930 is programmed to a conductive state. In order to drive current in a direction opposite the arrow 950, current is driven from the auxiliary column conductor 944, through the diode 920 and to the row conductor 940. The voltage of the auxiliary column conductor is in a high state and the voltage of the row conductor 940 is in a low state. The voltage of the primary conductor 942 is also placed in the high state (or at a voltage near the voltage of the auxiliary conductor 944). This prevents substantial amounts of current flowing through the variable optical element 910. As a result, current flows through the programmable resistance in a direction opposite the arrow 950 and programs to programmable resistance 930 to a conductive state.

The programmable resistance 930 of each of the display elements 900 may be programmed to a conductive state or to a resistive state, as described above. In one example embodiment, programming may be done one display element at a time. In another example embodiment, a multiplicity of display elements on a row may be programmed simultaneously by independent control of column voltages. In one example embodiment, the bias of a row or group of rows is set. Then groups of columns may be programmed. The groupings of columns may be of any size.

Once each programmable resistance 930 of each of the display elements 900 is programmed during the programming cycle, the row conductors, such as row conductor 940, are connected to a supply voltage and the primary columns, such as primary column 942, are connected to ground during a viewing cycle. This results in powering substantially the entire array 901 of display elements 900 without having to refresh the display elements 900. The optical state of each display element 900 is determined by the resistance of programmable resistance 930. In one example embodiment, the display element 900 may be programmed to one of a plurality of resistance levels. At higher levels of resistance, less current will flow through the display element 900. Thus, the programmable resistor 930 may be programmed to control a light output from a variable optical element 910, such as an OLED to provide a gray scale capability for the various display elements. During the viewing cycle, the auxiliary column 944 may be held at the supply voltage, a fixed voltage, or allowed to float.

Figure 10:
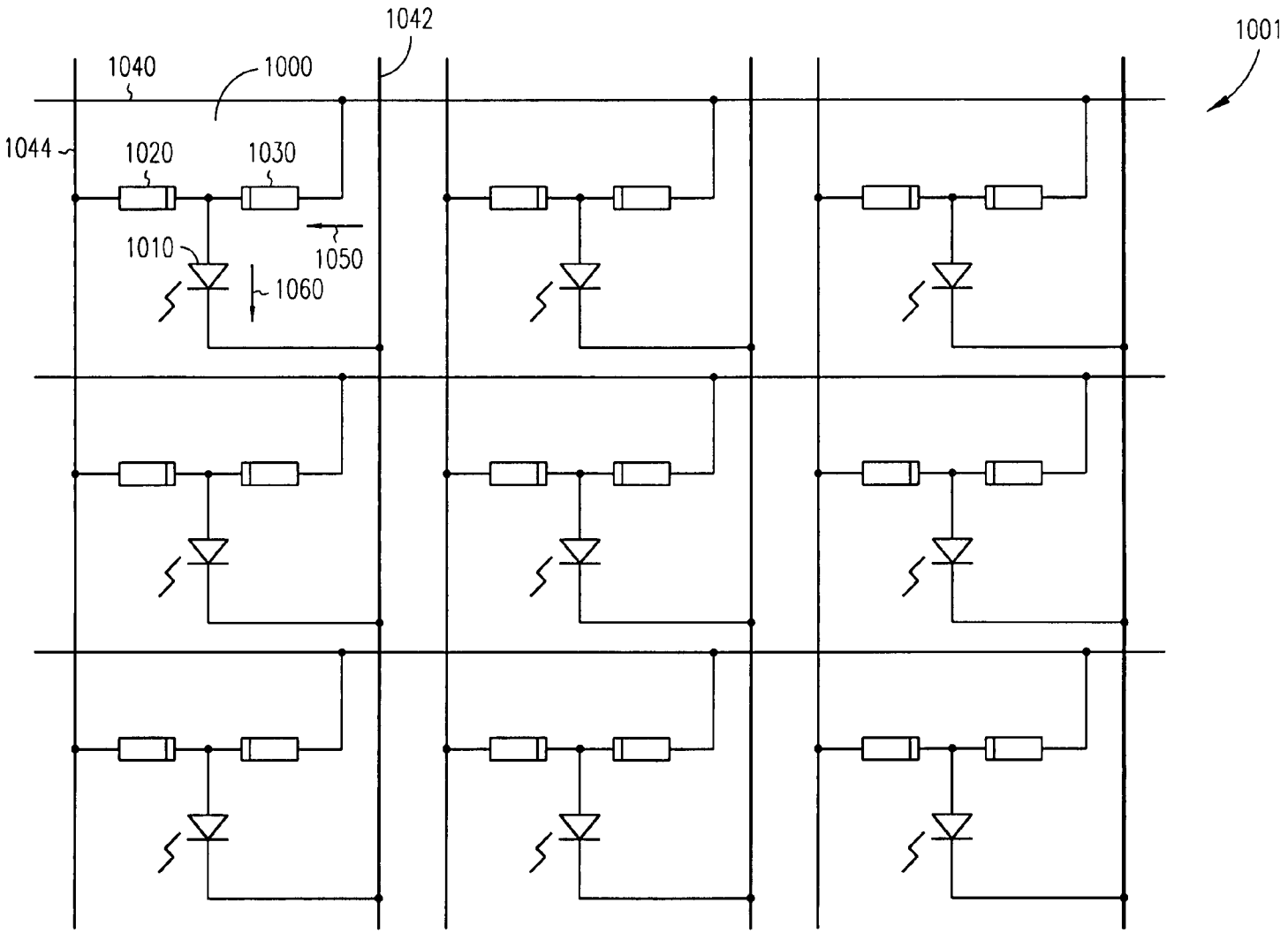
FIG. 10 is a schematic diagram of an array having a plurality of display elements, according to another example embodiment.

FIG. 10 is a schematic diagram of an array 1001 having a plurality of display elements, including a display element 1000 that includes a variable optical element 1010, a first programmable resistance 1020 and a second programmable resistance 1030, according to an example embodiment. The array 1001 may be a portion of a display. The array 1001 includes a number of display elements. Since the display elements are substantially the same, one display element 1000 is described below. The display 1001 also includes a row conductor 1040, a primary column conductor 1042, and an auxiliary column conductor 1044, according to an example embodiment. The second programmable resistance 1030 is coupled to the row conductor 1040. The second programmable resistance 1030 is also coupled to the variable optical element 1010 and the first programmable resistance 1020. The first programmable resistance 1020 is coupled to the auxiliary column conductor 1044. The variable optical element 1010 is coupled to the primary column conductor 1042. As shown in FIG. 10, the variable optical element 1010 is a light emitting diode ("LED"). In some embodiments, the variable optical element 1010 is an organic light emitting diode ("OLED").

In operation, the array 1001 is programmed during a programming cycle and viewed during a viewing cycle. During the programming cycle, current may be driven in the direction of an arrow 1050 (a first direction) to program the second programmable resistance 1030 to a resistive state. Current is also driven through the variable optical element 1010 in the direction of an arrow 1060. The direction of the arrow 1060 is a forward bias direction of an LED or an OLED.

When programming the second programmable resistance 1030 to a resistive state, the row conductor 1040 is at a high voltage and the primary column conductor 1042 is at a low voltage state. Generally, the first programmable resistance 1020 is maintained in a high resistive state. Therefore, when programming begins, the first programmable resistance 1020 is in a resistive state to prevent substantial amounts of current flow through the first programmable resistance 1020 to the auxiliary column conductor 1044. The auxiliary column conductor 1044 is then set to have a voltage similar to the row conductor 1040. In another embodiment, the voltage of the auxiliary column conductor 1044 is then allowed to float. The second programmable resistance is then programmed to a resistive state by pulsing current through the second programmable resistance 1030 and the variable optical element 1010. When the second programmable resistance 1030 is programmed to a resistive state, this turns the variable optical element 1010 off. As a result, the variable optical element 1010 does not light during a viewing cycle.

The second programmable resistance 1030 is programmed to a conductive state by passing current through the second programmable resistance 1030 in a direction opposite the arrow 1050 (a second direction). Programming the second programmable resistance 1030 to a conductive state allows the variable optical element 1010 to be enabled during the viewing cycle. When programming the second programmable resistance 1030 to a conductive state, the auxiliary column conductor 1044 is set to a high voltage while the row conductor 1040 is set to a low voltage. This allows programming of the second programmable resistance 1030 without having to pass current through the variable optical element 1010 in a direction opposite the arrow 1060. If the variable optical element 1010 is an LED or an OLED, the direction opposite the arrow 1060 corresponds to a reverse bias direction with respect to an LED or OLED. Once the second programmable resistance 1030 is programmed to a conductive state, the variable optical element may be viewed during the viewing cycle with current passing through the second programmable resistance 1030 and through the variable optical element 1010 in the direction of arrows 1050 and 1060, respectively.

Programming the second programmable resistance 1030 to a conductive state simultaneously programs the first programmable resistance 1020 to a resistive state because the first and second programmable resistors are oppositely oriented. Therefore, the same programming sequence described in the preceding paragraph to set the second programmable resistance 1030 to a conductive state may be used to program the first programmable resistance 1020 to a resistive state. When viewing the display or when programming the second programmable resistance 1030 to a high resistance state, the first programmable resistance is in a high resistance state.

In one example of the programming cycle, each of the first programmable resistances 1020 initially are set to a high resistance state (each of the second programmable resistances 1030 are simultaneously set to a conductive state). This programming step sets each of the pixels into the "on" state. Next, those pixels that are chosen to be off are programmed into the "off" state. This programming sequence ensures that each of the first programmable resistances 1020 are in the high resistance state both when programming second programmable resistances 1030 to the high resistance (off) state and when viewing the display.

The second programmable resistance 1030 of each of the display elements 1000 may be programmed to a conductive state or to a resistive state, as described above. In one example embodiment, programming may be done one display element at a time. In another example embodiment, a multiplicity of display elements on a row may be programmed simultaneously by independent control of column voltages. In one example embodiment, the bias of a row or group of rows is set. The group's columns may be programmed. The groupings of columns may be of any size.

Once each second programmable resistance 1030 of each of the display elements 1000 is programmed during the programming cycle, the row conductors, such as row conductor 1040, are connected to a supply voltage and the primary columns, such as primary column 1042, are connected to ground during a viewing cycle. This results in powering substantially the entire array 1001 of display elements 1000 without having to refresh the display elements 1000. The optical state of each display element 1000 is determined by the resistance of second programmable resistance 1030. In one example embodiment, the display element 1000 may be programmed to one of a plurality of resistance levels. At higher levels of resistance, less current flows through the display element 1000 and specifically through the variable optical element 1010. Thus, the second programmable resistance 1030 may be programmed to control a light output from a variable optical element 1010, such as an OLED or LED, to provide a gray scale capability for the various display elements. During the viewing cycle, the auxiliary column 1044 may be held at the supply voltage or allowed to float.

Figure 11:
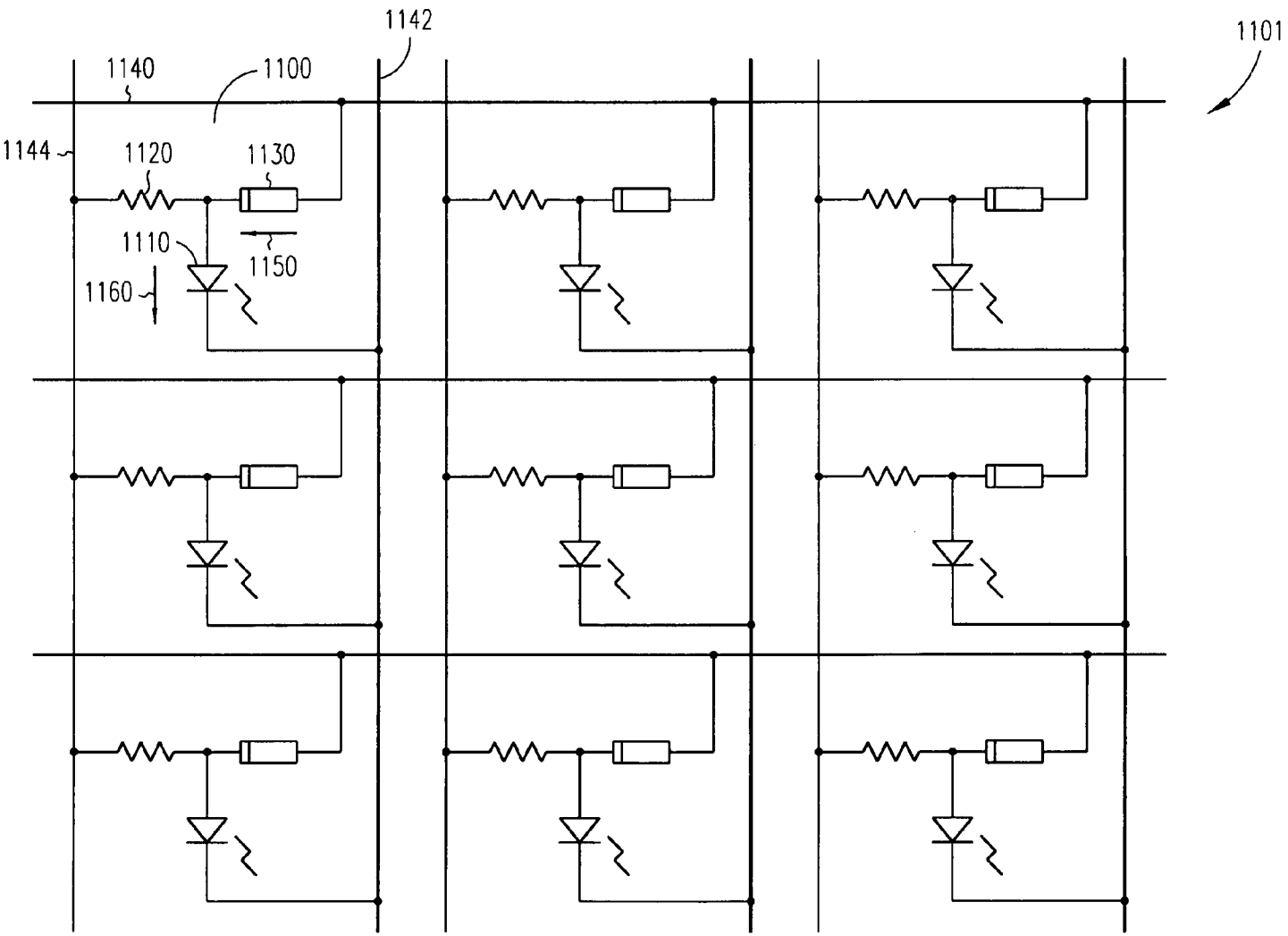
FIG. 11 is a schematic diagram of an array having a plurality of display elements, according to an example embodiment.

FIG. 11 is a schematic diagram of an array 1101 having a plurality of display elements, including a display element 1100 that includes a variable optical element 1110, a fixed resistance 1120 and a programmable resistance 1130, according to an example embodiment. The array 1101 may be a portion of a display. The array 1101 includes a number of display elements. Since the display elements are substantially the same, one display element 1100 is described below. The display 1101 also includes a row conductor 1140, a primary column conductor 1142, and an auxiliary column conductor 1144, according to an example embodiment. The programmable resistance 1130 is coupled to the row conductor 1140. The programmable resistance 1130 is also coupled to the variable optical element 1110 and the fixed resistance 1120. The fixed resistance 1120 is coupled to the auxiliary column conductor 1144. The variable optical element 1110 is coupled to the primary column conductor 1142. As shown in FIG. 11, the variable optical element 1110 is a light emitting diode ("LED"). In some embodiments, the variable optical element 1110 is an organic light emitting diode ("OLED").

In operation, the array 1101 is programmed during a programming cycle and viewed during a viewing cycle. During the programming cycle, current may be driven in the direction of an arrow 1150 (a first direction) to program the programmable resistance 1130 to a resistive state. Current is also driven through the variable optical element 1110 in the direction of an arrow 1160. The direction of the arrow 1160 is a forward bias direction of an LED or an OLED.

When programming the programmable resistance 1130 to a resistive state, the row conductor 1140 is at a high voltage and the primary column conductor 1142 is at a low voltage state. When programming the programmable resistance 1130 to a resistive state, the fixed resistance 1120 prevents substantial amounts of current flow through the fixed resistance 1120 to the auxiliary column conductor 1144. The auxiliary column conductor 1144 then is set to have a voltage similar to the row conductor 1140. In another embodiment, the voltage of the auxiliary column conductor 1144 then is allowed to float. The programmable resistance 1130 is then programmed to a resistive state by pulsing current through the programmable resistance 1130 and the variable optical element 1110. When the programmable resistance 1130 is programmed to a resistive state, this turns the variable optical element 1110 off. As a result, the variable optical element 1110 does not light during a viewing cycle.

The programmable resistance 1130 is programmed to a conductive state by passing current through the programmable resistance 1130 in a direction opposite the arrow 1150 (a second direction). Programming the programmable resistance 1130 to a conductive state allows the variable optical element 1110 to be enabled during the viewing cycle. When programming the programmable resistance 1130 to a conductive state, the auxiliary column conductor 1144 is set to a high voltage while the row conductor 1140 is set to a low voltage. This allows programming of the programmable resistance 1130 without having to pass current through the variable optical element 1110 in a direction opposite the arrow 1160. If the variable optical element 1110 is an LED or an OLED, the direction opposite the arrow 1160 corresponds to a reverse bias direction with respect to an LED or OLED. Once the programmable resistance 1130 is programmed to a conductive state, the variable optical element may be viewed during the viewing cycle with current passing through the programmable resistance 1130 and through the variable optical element 1110 in the direction of arrows 1150 and 1160, respectively.

The programmable resistance 1130 of each of the display elements 1100 may be programmed to a conductive state or to a resistive state, as described above. In one example embodiment, programming may be done one display element at a time. In another example embodiment, a multiplicity of display elements on a row may be programmed simultaneously by independent control of column voltages. In one example embodiment, the bias of a row or group of rows is set. Then single columns are programmed. The groupings of columns may be of any size.

Once each programmable resistance 1130 of each of the display elements 1100 is programmed during the programming cycle, the row conductors, such as row conductor 1140, are connected to a supply voltage and the primary columns, such as primary column 1142, are connected to ground during a viewing cycle. This results in powering substantially the entire array 1101 of display elements 1100 without having to refresh the display elements 1100. The optical state of each display element 1100 is determined by the resistance of programmable resistance 1130. In one example embodiment, the display element 1100 may be programmed to one of a plurality of resistance levels. At higher levels of resistance, less current will flow through the display element 1100 and specifically through the variable optical element 1110. Thus, the programmable resistance 1130 may be programmed to control a light output from a variable optical element 1110, such as an OLED or LED, to provide a gray scale capability for the various display elements. During the viewing cycle, the auxiliary column 1144 may be held at the supply voltage or allowed to float.

Although specific embodiments have been illustrated and described herein, those of ordinary skill in the art will appreciate that any arrangement calculated to achieve the same purpose may be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

The invention claimed is:

1. A display device, comprising:

a variable optical element that changes appearance in response to changes in current; and a programmable resistance element in series with the variable optical element, the programmable resistance element including an electrolyte and a source of ions and further having a continuum of programmable resistances for setting a gray level of the optical element, resistance of the programmable resistance element continually increasing as current flows therethrough in a first direction, and the resistance of the programmable resistance element continually decreasing as current flows therethrough in a second direction, whereby gray level of the optical element is programmed by programming the resistance of the resistance element.

2. The display device of claim 1 wherein the second current in the second direction is opposite the first current in the first direction.

3. The display device of claim 1 wherein the variable optical element includes a light emitting diode.

4. The display device of claim 1 wherein the variable optical element includes an organic light emitting diode.

5. The display device of claim 1 wherein the programmable resistance element includes a thin film resistive element having first and second electrodes and the electrolyte in between.

6. The display device of claim 1, further comprising a diode connected to the optical element such that the diode passes current in one of the first and second direction without having to pass current through the optical element.

7. The display device of claim 1 wherein the variable optical element includes a light emitting diode having a polarity in a first direction, the display device further comprising a diode having a polarity in a second direction, the diode connected to the light emitting diode such that the diode passes current without having to pass current through the optical element.

8. The display device of claim 1 wherein the variable optical element includes a light emitting diode having a first polarity in a first direction, the display device further comprising a diode having a second polarity in a second direction, the diode connected to the light emitting diode such that the polarity of the diode opposes the first polarity of the light emitting diode.

9. A method of operating a programmable pixel in a matrix display, the pixel including the display device of claim 1, the method comprising:

applying current in a first direction to increase a resistance of the programmable resistance device; and applying current in a second direction to decrease the resistance of the programmable resistance element.

10. The method of claim 9, further comprising applying a lower level current in the first direction to light the optical element.

11. The method of claim 9 wherein applying current in the second direction to decrease the resistance of the programmable resistance element includes applying current to a diode connected to the optical element, the diode having a path of least resistance in the second direction of current flow.

12. The method of claim 9 wherein applying current in the first direction to the programmable resistance element includes diffusing at least some of a source of ions out of the electrolyte.

13. The method of claim 9 wherein applying current in the second direction to the programmable resistance element includes diffusing at least some of ions into the electrolyte.

14. The display device of claim 1 wherein the programmable resistance element and the optical element are stacked directly together.

15. A display, comprising:

a plurality of display devices arranged in an array, wherein at least a portion of the display devices includes:

an optical element that changes appearance in response to changes in current; and a programmable resistance element for setting a gray level of the optical element, the programmable resistance element i) in series with the optical element, ii) including an electrolyte and a source of ions, and iii) further having a continuum of programmable resistances, a resistance of the programmable resistance element continually increasing as a first current flows therethrough in a first direction, and the resistance of the programmable resistance element continually decreasing as a second current flows therethrough in a second direction;

a plurality of rows of conductors; and a plurality of columns of conductors;

wherein at least a portion of the display devices are connected between one of the plurality of rows of conductors and one of the plurality of columns of conductors.

16. The display of claim 15, further comprising a source of current for selectively increasing or decreasing the resistance of the programmable resistance element.

17. The display of claim 15 wherein the optical element includes a light emitting diode.

18. The display of claim 15 wherein the optical element includes an organic light emitting diode.

19. The display of claim 15 wherein the source of ions is configured to diffuse out of the electrolyte in response to the first current in the first direction and to diffuse into the electrolyte in response to the second current in the second direction.

20. The display of claim 15, further comprising a diode connected to the optical element such that the diode passes current in one of the first and second direction without having to pass current through the optical element.

21. The display of claim 17 wherein the light emitting diode has a first polarity in a first direction, the display further comprising a diode having a second polarity in a second direction, the diode connected to the light emitting diode such that the diode passes current without having to pass current through the optical element.

22. The display of claim 17 wherein the light emitting diode has a first polarity in a first direction, the display further comprising a diode having a second polarity in a second direction, the diode connected to the light emitting diode such that the second polarity of the diode opposes the first polarity of the light emitting diode.

23. A display device, comprising:

a variable optical element that changes appearance in response to changes in voltage bias across the variable optical element; and a programmable resistance element in series with the variable optical element, the programmable resistance element including an electrolyte and a source of ions and further having a continuum of programmable resistances for setting a gray level of the optical element, a resistance of the programmable resistance element continually increasing as a first voltage bias is applied in a first direction, and the resistance of the programmable resistance element continually decreasing as a second bias is applied in a second, opposite direction.

24. The display device of claim 23 wherein the variable optical element includes a light emitting diode.

25. The display device of claim 23 wherein the variable optical element includes an organic light emitting diode.

26. The display device of claim 23 wherein, in response to varying a level of resistance associated with the programmable resistance element, different current levels are driven through the variable optical element to produce a gray scale of light emitted from the variable optical element.

27. A method of operating a programmable pixel in a matrix display, the pixel including the display of claim 23, the method comprising biasing the programmable resistance device at one of the voltage biases over a duration of a viewing cycle.

28. The display of claim 14, further comprising means for programming the resistance element without running current through the optical element.

* * * * *